United States Patent [19]

Fuell

[11] 4,150,604

[45] Apr. 24, 1979

[54] BIASED PRESSURE FEEDBACK MODULE

[75] Inventor: Frederick J. Fuell, Hounslow, England

[73] Assignee: Fairey Hydraulics Limited, Hounslow, England

[21] Appl. No.: 799,608

[22] Filed: May 23, 1977

[30] Foreign Application Priority Data

May 25, 1976 [GB] United Kingdom ..... 21672/76

[51] Int. Cl.[2] ..... F15B 11/16; F15B 13/06; F01B 15/00; F15B 9/10

[52] U.S. Cl. ..... 91/216 A; 91/372; 91/509; 91/518; 91/523

[58] Field of Search ..... 91/434, 370, 371, 372, 91/373, 216 A, 413, 411 A

[56] References Cited

U.S. PATENT DOCUMENTS

| | | | |
|---|---|---|---|
| 3,012,577 | 12/1961 | Ambrosini | 91/434 |
| 3,272,062 | 9/1966 | Flippo et al. | 91/411 A |
| 3,398,647 | 8/1968 | Baltus et al. | 91/384 |

*Primary Examiner*—Paul E. Maslousky

*Attorney, Agent, or Firm*—Watson, Cole, Grindle & Watson

[57] ABSTRACT

A multiple servo system including two or more servo mechanisms, each having a pressure feed back including two pistons exposed in respective chambers interconnected by a low-pass hydraulic filter, in which the area of the two feedback piston faces differ by up to 25%. This reduces the tendency of the respective actuators to act in opposition and thus increases the service life of the system.

8 Claims, 1 Drawing Figure

BIASED PRESSURE FEEDBACK MODULE

Figure 1:
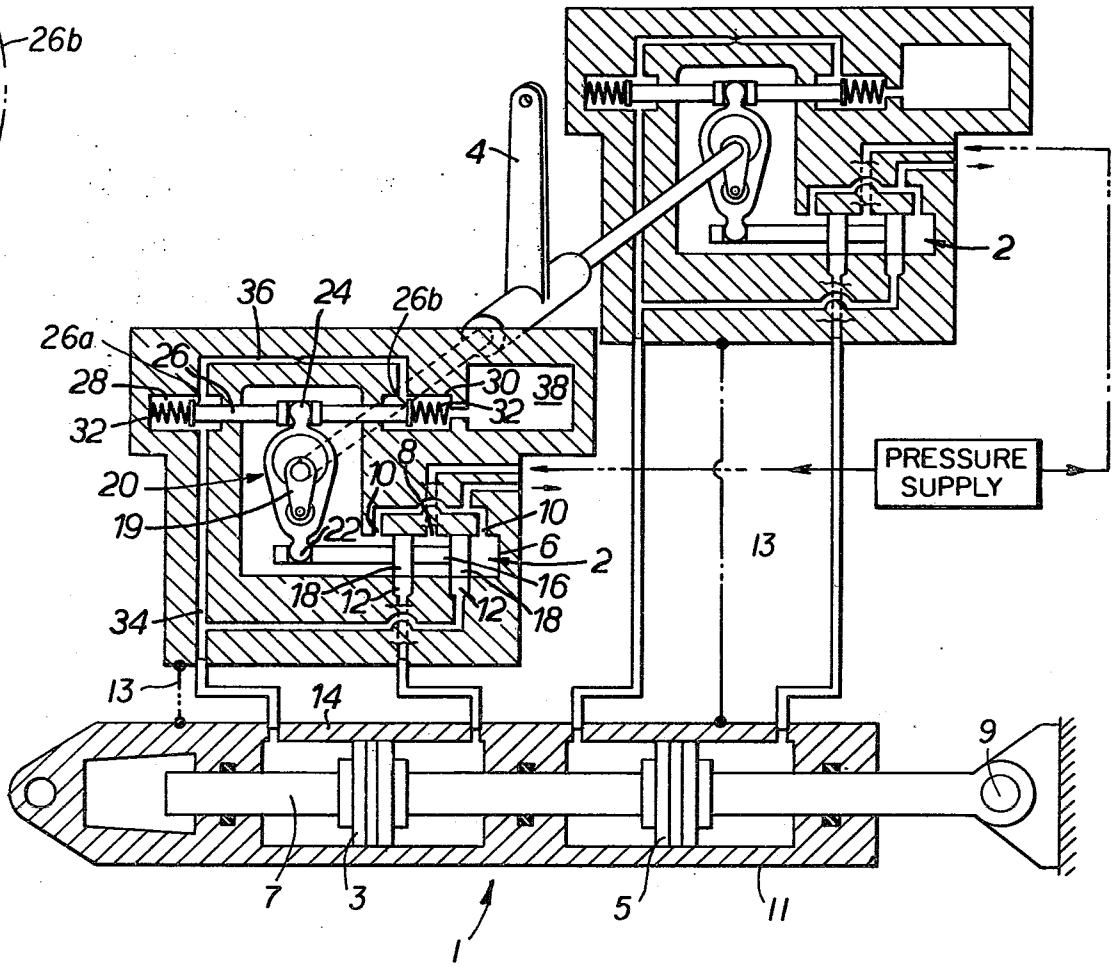

This invention relates to multiple positioning servo systems of the type including at least two servo mechanisms actuated by a single control member, and acting on a single load, each mechanism including a servo valve and a hydraulic actuator. Such multiple systems are particularly desirable in hydraulic power control systems for aircraft, to which the invention is particularly although not exclusively applicable. The invention is applicable to duplicated, triplicated or other multiple systems but for convenience will be described as applied to duplicated systems. In such a system incorporating a duplicated servo mechanism each mechanism commonly comprises a double acting hydraulic actuator having opposed piston faces, exposed respectively in a first cylinder chamber and a second cylinder chamber and acting on a load, a servo valve controlling connection of each cylinder chamber to a pressure supply and exhaust in opposite senses, and a mechanical feedback connection whereby movement of the actuator in response to movement of the servo valve tends to restore the servo valve to a neutral position.

In order to control the dynamic stability of each mechanism and to absorb sudden changes of load, pressure feedback means are provided comprising a first feedback chamber and a second feedback chamber which are interconnected by a low-pass hyraulic filter and of which the first chamber is connected to the first cylinder chamber, and opposed piston faces exposed respectively in the two feedback chambers and urged resiliently towards a neutral position and acting in opposition on a valve so connected that a rise of pressure in the first cylinder chamber and hence in the first feedback chamber moves the valve to cause a fall of pressure in the said first cylinder chamber and/or a rise of pressure in the second cylinder chamber, while a fall of pressure in the first cylinder chamber produces the opposite effect.

Such a mechanism has been described and claimed for example in the present applicants' British Pat. specification No. 12157,68.

As discussed more fully below such a mechanism is insenstive to a gradually changing load or a dead load and a low frequency blocked pressure feedback means does not alter this fact due to the action of the low-pass filter. In the case of a single system this is of no consequence. With a multiple system, on the other hand, small differences in the position of the two servo valves arising from, for example, backlash or temperature effects, will affect the behaviour of the multiple actuator. Since small movements of the actuator may be prevented by the companion actuator, by producing an opposite difference of pressure between the ends of the latter actuator, a build-up of pressure difference may continue in both actuators until they are producing substantial forces in opposite directions, even in the absence of any output load. This condition, which may be compared to a tug-of-war, not only impairs the operational characteristics of the servo system, but can also reduce its operational life. An object of the present invention is to reduce or avoid this condition.

In accordance with the present invention, this is achieved by making the areas of the piston faces in the two chambers of the pressure feedback means of each mechanism unequal, so that a change of pressure common to both feedback chambers will move the piston and valve against its resilient restraint. The areas of the piston faces may differ by up to 25%, but preferably differ by 10%.

The pressure feedback means of each system may comprise a valve separate from its associated servo valve but alternatively and preferably the piston of the pressure feedback means acts on the servo valve jointly with the control member through a differential mechanism such as a lever.

The low-pass hydraulic filter may comprise a restricted orifice and a compliant volume, corresponding to an electrical resistor and capacitor.

Figure 2:
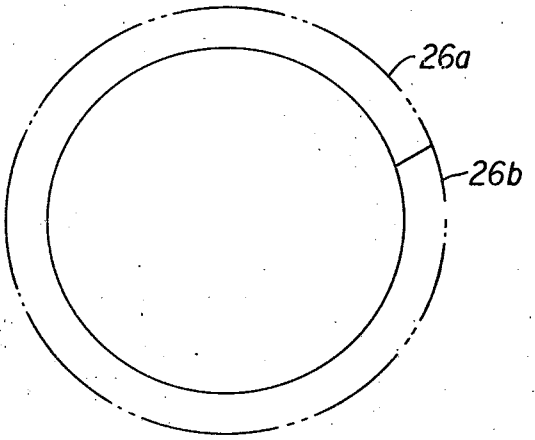

In the accompanying drawing, FIG. 1 is a diagram of a duplicated servo system according to the invention for use in an aircraft, and FIG. 2 is a plan view, at a greatly enlarged scale, showing the relative sizes of the piston faces in first and second feedback chambers.

The system comprises two servo mechanisms connected to a common pilot's control lever 4 and having respective actuators connected together in tandem as at 1 and acting on a common load, the actuators comprising double acting piston in a cylinder 11. The common pistons 3 and 5 rod 7 is anchored as at 9 at one end so that the output movement is applied to the cylinder 11 which carries as at 13 the servo mechanisms so as to give a follow up or negative feedback effect.

The two servo mechanisms are identical and it will therefore be sufficient to describe only one of them.

The mechanism comprises a servo valve 2 of spool type connected to the common control and comprising a valve cylinder 6 having a central inlet portion 8 connected to a high-pressure supply (shown diagrammatically in FIG. 1), and a pair of exhaust end ports 10 connected to a return pipe. A pair of working ports 12 are connected respectively to opposite ends of an actuator cylinder 14, relative to one of the two aforementioned actuators, and the valve piston or spool 16 has a pair of lands 18 spaced to cover the respective working ports in a neutral position.

As discussed more fully below the valve spool acts as a pair of pressure potential dividers which maintain equal pressures, known as the base pressure, in opposite ends of the actuator when unloaded. When the spool is moved in one direction it will connect one end of the actuator to pressure and the other end to exhaust, so as to cause the actuator cylinder 11, and with it the entire servo mechanism, to follow up the movement of the valve spool and cover the ports.

Regarding the operation of the mechanical feedback, if the pilot's lever 4 is for example moved to the left in a counterclockwise direction, as viewed in FIG. 1, the shaft on which it is mounted will likewise rotate counterclockwise about its longitudinal axis. This shaft is rigidly connected to intermediate lever 19 which is pivotally connected at its lower end to floating lever 20. Thus, counterclockwise rotation of the shaft will result in the lower ends of levers 19 and 20 moving to the right when viewed in FIG. 1. Spool valve 16, which is connected to lever 20, is therefore moved to the right so that the lands 18 of the spool valve will uncover ports 12, thus connecting the left-hand chamber of each of the pairs of actuator chambers to high pressure and the right-hand chambers to low pressures. Actuator piston 7 is fixed as to 9 to an earth structure so that the pressure differential causes actuator cylinder 11 and the two servo mechanisms connected thereto to move to the left. The shaft on which the pilot's lever is mounted is restrained against linear, but not rotary, movement with the result that as the servo mechanisms move leftward, the lower end of the floating lever 19 moves leftward with respect to its upper end, which in turn results in the spool valve 16 moving leftward with respect to its valve cylinder. Thus, when the servo mechanisms have moved a predetermined distance, the spool valve and the pilot's lever are again in their neutral position and no further movement occurs. In other words, if the upper free end of lever 4 is constrained so as not to be further moved after having been initially moved counterclockwise, the leftward movement of the actuator cylinder and the two mechanisms will cause the lower end of the pilot's lever as well as the shaft mounted thereon to effectively pivot about the lever's upper end so that the shaft will rotate clockwise to thus cause spool valve 16 to return to its initial position of FIG. 1 whereby ports 12 are re-closed.

An actuator with sucn an arrangement will have virtually infinite stiffness in the face of output load and can consequently be dynamically unstable.

To overcome this it has been proposed, for example in the British patent specification referred to above, to provide pressure feedback means permitting fluid to flow to and from the actuator in response to forces exerted on it.

In the present embodiment such pressure feedback means is arranged to act on the servo valve itself, but it also embodies a low frequency blocking arrangement to inhibit operation of the pressure feedback in the steady state whilst permitting its operation under dynamic conditions. Thus the pilot's control lever 4 acts on the intermediate point 19 of a floating lever 20 having one end 22 connected to the servo valve and the opposite end 24 connected to a double acting piston 26 of the pressure feedback means. The piston is in the form of a rod opposite ends of which are exposed in a pair of feedback chambers 28 and 30 and are acted upon in opposition by helical springs 32 tending to centre the piston rod. One feedback chamber 28, which will be referred to as the first chamber, is connected by means of a pressure line 34 to one end of the actuator cylinder which will be referred to as the first end. The other or second feedback chamber 30 is connected to the first feedback chamber 28 through a restricted passageway 36 and is also connected to a substantial volume of oil in a closed space 38, known as a compliant volume. The restricted passageway 36 and the compliant volume 38 together form a low-pass hydraulic filter equalising slow and prolonged differences of pressure between the two feedback chambers while not affecting comparatively rapid high frequency changes.

Accordingly in operation if a sudden load is applied to the actuator so as to raise the pressure in the first end of the cylinder 14 and hence in the first feedback chamber 28, the rise of pressure will not immediately be transmitted to the second chamber 30 and hence the pressure feedback piston 26 will be moved longitudinally to the right when viewing FIG. 1, so as to shift the servo valve. The connections are such that this will lower the pressure in the first end of the cylinder and raise it in the second end of the cylinder so that the actuator will yield to the sudden load applied to it. This dissipates hydraulic power to stabilise the system instead of destabilising it which would be the effect if no pressure feedback means were incorporated. A sudden fall of pressure in the first end of the cylinder produces the opposite effect.

On the other hand if a slowly increasing load is applied to the actuator the gradual rise of pressure in the first end of the cylinder and in the first feedback chamber 28 will have time to be communicated through the restricted passageway 36 to the second feedback chamber 30 and the complaint volume 38, so that the pressure feedback means is insensitive to gradually changing loads.

As indicated above, the actuator is a tandem unit and there are two mechanisms as described above. With such an arrangement, as discussed more fully below, the problem arises that as the pressure feedback is insensitive to a dead load or a slow change of pressure in the first feedback chamber it is possible (with slight malphasing of the valves) to produce significantly unequal pressures in corresponding ends of the two actuators, and this tends to degrade the performance of the unit and impair its fatigue life.

Thus in accordance with the present invention the effective area of the piston face **26*a* in the first feedback chamber 28 of each mechanism is made larger than the effective area of the piston face 26*b* in the second chamber 30, for example about 10% larger. FIG. 2 illustrates the comparative sizes of these piston faces. Thus if the pressure in the first feedback chamber rises so gradually that a substantially equal rise occurs in the second feedback chamber it will none the less exert a resultant force on the piston rod 26 and shift is against its restoring springs 30 thereby shifting the servo valve so as to tend to reduce the pressure differential across the two ends of the actuator cylinder. It can be therefore seen that, if the pilot's lever 4 is moved to the left, the servo mechanisms physically connected thereto (as shown diagrammatically in FIG. 1**) also move to the left until such time as the pilot's lever is again in its neutral position when no further movement occurs.

In servo mechanisms of the type described, each servo valve normally operates as a pair of pressure potential and flow dividers as briefly referred to above. If the widths of the ports and lands are so chosen that each servo valve forms a pair of pressure potential dividers having a range of movement during which leakage occurs and the pressure in the associted working port varies progressively from supply pressure to exhaust pressure. To ensure sensitive operation the widths and spacing of the lands are substantially equal to those of the working ports, but even if both the pressure and exhaust edges of a valve land cover a working port leakage will occur at the high pressures employed (several thousand p.s.i.) due to radial clearance between the valve piston and cylinder. The spacing of the ports and lands is chosen so that the pressures in the two working ports are balanced when each has a desired valve known as the base pressure, which may conveniently be known as the base pressure, which may conveniently be halfway between supply and exhaust pressure.

Such a servo mechanism, for example for aircraft controls, is designed to provide a high response, for example to respond to movements of less than one thousandth of an inch (25$\mu$) and hence the operation may be affected by very small changes in the operating mechanism, for example expansion due to changes of temperature, tolerance in bearings and other factors of this kind.

In a duplicated or multiple system, each mechanism will resist any movement due to unbalanced pressure in the companion mechanism, so that instead of pressures being balanced in opposite ends of each actuator, high pressure will build up in one end of one actuator and the opposite end of the other actuator and low pressure in the remaining ends, the two actuators exerting equal resultant forces in opposite directions. As indicated above, this tends to degrade the performance of the unit and impair its fatigue life.

This is reduced prevented very simply (indeed with no additional components) by making the areas of the feedback pistons of each mechanism unequal. Thus for example if the area of one piston is 10% greater than that of the other there will be a neutral position in which the resultant force exerted by the springs on the pistons of the feedback mechanism is balanced by the application of the desired base pressure to one tenth of the area of the feedback piston. The system will adjust itself so that both mechanisms simultaneously occupy positions satisfying this condition. If, then, this adjustment should subsequently be disturbed, the pistons of the feedback mechanisms will respond in such a way as to substantially reduce any pressure difference between corresponding ends of the two actuators.

Thus if the operating mechanism should vary so that one servo valve is in a position such as to cause a higher pressure in its actuator in the extending direction, while the other servo valve is displaced by a small distance (perhaps a few ten thousandths of an inch) from a corresonding position to cause a higher pressure in the retracting direction, the feedback pistons will cause the corresponding servo valves to be displaced in opposite directions to substantially reduce and virtually eliminate the difference, thus greatly reducing what may be termed the tug-of-war force between the two actuators.

It will be appreciated that if a dead load is applied to the tandem actuator the servo valves tend to reduce the differential pressures resisting the load within the actuator to levels lower than would be the case for a given actuator displacement in the construction according to the aformentioned British patent. Thus a given dead load will displace the actuator further than is the case in such construction. This slight loss of static stiffness is however of minor significance compared to the improved performance due to the removal of the so called tug-of-war between the two actuators.

Furthermore the synchronizing effect of the pressure feedback motions, as described, will improve the small amplitude performance of the tandem actuator which is degraded in the prior construction referred to because of the malphasing caused by the disparity between the valve positions.

The invention may also be applied to a triplicated or other multiple arrangement, the arrangement being analogous to that specifically described but with one or more additional mechanisms.

What we claim as our invention and desire to secure by Letters Patent is:

1. A servo system including at least two servo mechanisms actuated by a single control member and adapted to act on a single load, the mechanisms including hydraulic actuators having opposed piston faces exposed respectively in first cylinder chambers and in second cylinder chambers, and servo valves controlling connection of the cylinder chambers to a pressure supply and exhaust in oppoiste senses, a mechanical feedback connection whereby movement of the actuators in response to movement of the servo valves tends to restore the servo valves to a neutral position, and pressure feedback means comprising first and second feedback pistons having piston faces exposed respectively in first and second feedback chambers which are respectively interconnected by low-pass hydraulic filters and of which the first feedback chambers are connected to the first cylinder chambers of the hydraulic actuators, the feedback pistons being urged resiliently towards a neutral position and acting in opposition on said servo valves so connected that a rise of pressure in the first cylinder chambers and hence in the first feedbackchambers moves the valves to cause a fall of pressure in the first cylinder chambers and/or a rise of pressure in the second cylinder chambers while a fall of pressure in the first cylinder chambers produces the opposite effect, characterized in that the areas of the piston faces in the first and second feedback chambers of the pressure feedback means are unequal, whereby during operation of the system, should one of the servo valves be displaced a first distance from its neutral position into a position causing a higher pressure in, for example, the first chamber of its hydraulic actuator in an extending direction while another of the servo valves is displaced a second distance from its neutral position causing a higher pressure in the second chamber of its hydraulic actuator, tending to urge the hydraulic actuator in a retracting direction, the differential forces acting on the feedback pistons will cause the respective servo valves to be displaced in directions opposite to the respective extending and retracting directions to thereby substantially reduce the first and second distances, thus substantially reducing what may be termed a tug-of-war force between the hyraulic actuators.

2. A system as claimed in claim 1 in which the areas of the piston faces of the pressure feedback means differ by up to 25%.

3. A system as claimed in claim 1 in which the areas of the piston faces of the pressure feedback means differ by 10%.

4. A system as claimed in claim 1 in which the piston faces of the pressure feedback means acts on the servo valves jointly with the control member through a differential mechanism such as a lever.

5. A system as claimed in claim 1 in which the hydraulic filter comprises a restricted orifice and a complaint volume.

6. A system as claimed in claim 1 in which the actuators are combined as a multiple actuator having a common output.

7. A system as claimed in claim 6 wherein said actuators are connected together in tandem and have a common piston rod.

8. A system is claimed in claim 1 in which the piston faces of the pressure feedback means acts directly on the servo valves jointly with the control member.

* * * * *